United States Patent [19]

Laurila

[11] 3,992,745

[45] Nov. 23, 1976

[54] CLEANING UNIT FOR INTERNAL MECHANICAL CLEANING OF CONTAINERS SUCH AS MOULDS

[75] Inventor: Jaakko Johanes Laurila, Hallefors, Sweden

[73] Assignee: Ferrox AB, Grythyttan, Sweden

[22] Filed: Jan. 28, 1975

[21] Appl. No.: 544,858

[30] Foreign Application Priority Data

Feb. 18, 1974 Sweden ..... 7401686
July 18, 1974 Sweden ..... 7409367

[52] U.S. Cl. ..... 15/56; 15/72; 15/104.2; 15/165; 164/158

[51] Int. Cl.[2] ..... B67C 1/08; A46B 7/02; A46B 13/02

[58] Field of Search ..... 15/21 R, 56, 57, 72, 15/73, 101, 160, 165, 201, 212, 304, 345, 104.2; 425/DIG. 116, 225, 226; 164/158

[56] References Cited

UNITED STATES PATENTS

| | | | |
|---|---|---|---|
| 2,673,363 | 3/1954 | Repper et al. | 15/165 X |
| 3,230,561 | 1/1956 | Taccone | 15/56 |

FOREIGN PATENTS OR APPLICATIONS

| | | | |
|---|---|---|---|
| 943,950 | 12/1963 | United Kingdom | 15/72 |
| 1,058,555 | 2/1967 | United Kingdom | 15/72 |

*Primary Examiner*—Edward L. Roberts
*Attorney, Agent, or Firm*—Hane, Baxley & Spiecens

[57] ABSTRACT

Cleaning the inside of a receptacle such as a chill mould by brushing the inside of the mold is effected by moving one or more brushes up and down within the mold. Each brush is generally disc-shaped and the periphery is shaped in conformity with the shape of the mold. The brushes are so arranged that the bristles thereon can be moved into and out of brushing engagement with the inside of the mold.

12 Claims, 9 Drawing Figures

CLEANING UNIT FOR INTERNAL MECHANICAL CLEANING OF CONTAINERS SUCH AS MOULDS

The present invention relates to mechanical cleaning the interior of containers. It has been known for a long time to use brushes for internal cleaning of containers, for instance bottles. For chill moulds, brushes are also used, which are mounted on a central shaft. However, it is difficult to clean chill moulds which have corners with such brushes.

The purpose of the present invention is to provide a cleaning unit primarily intended for cleaning chill moulds internally, including chill moulds which have corners. The cleaning is achieved by the use of transversal elements which are movable along a line through the shaft of the unit. The transversal element consists of at least two parts which are provided with brushes at their peripheries. The transversal parts are connected to a mechanism in such a way that the transversal parts are pressed against the wall of the chill mould with a certain force. Each part element has a contour corresponding to the corresponding contour of the chill mould.

According to the invention, an element is connected to an axial pressure piston system which can move the element axially along the chill mould. Several elements, arranged one after the other, can be connected to the pressure piston system.

According to the invention, it is also possible to have one or several elements actuated by a pressure piston system consisting of two or more pressure pistons. However, it is possible to use one pressure piston to which a number of parallel shafts are connected.

According to the invention it is further possible to have the device according to the invention provided with members by means of which the device can temporarily be secured to a chill mould.

The unit according to the invention can also be mounted on a vehicle, in such a way that the device can easily and simply be inserted into a chill mould without temporary securing.

The unit according to the invention can be provided with a control system that releases the pressure piston system when, for instance, one or several of the brushes of an element become jammed in a cavity in a chill mould.

Figure 1:
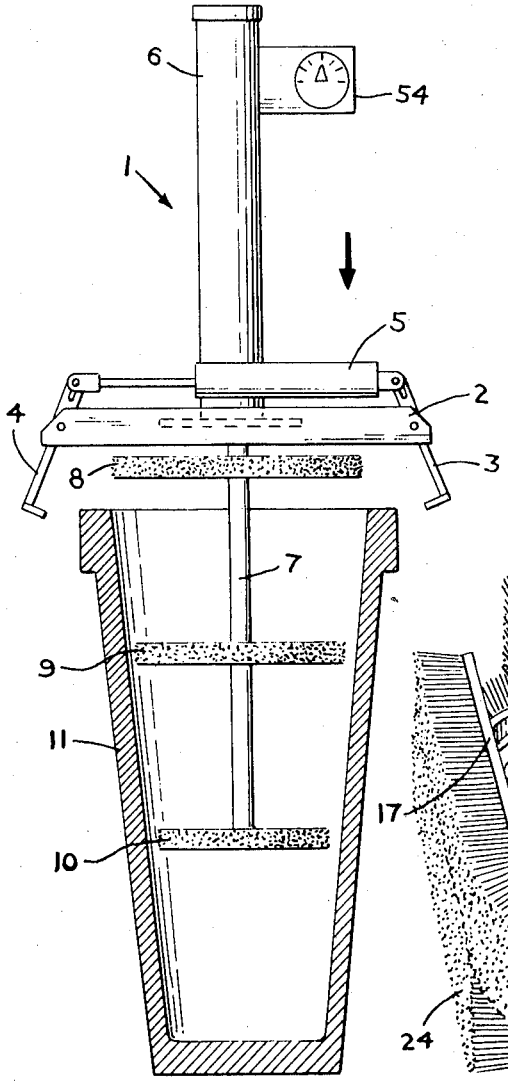
Figure 4:
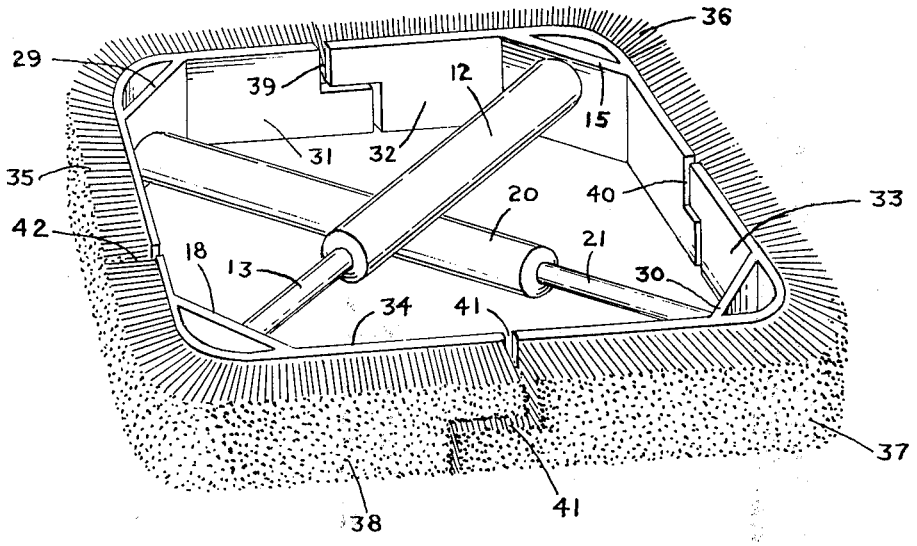
Figure 5:
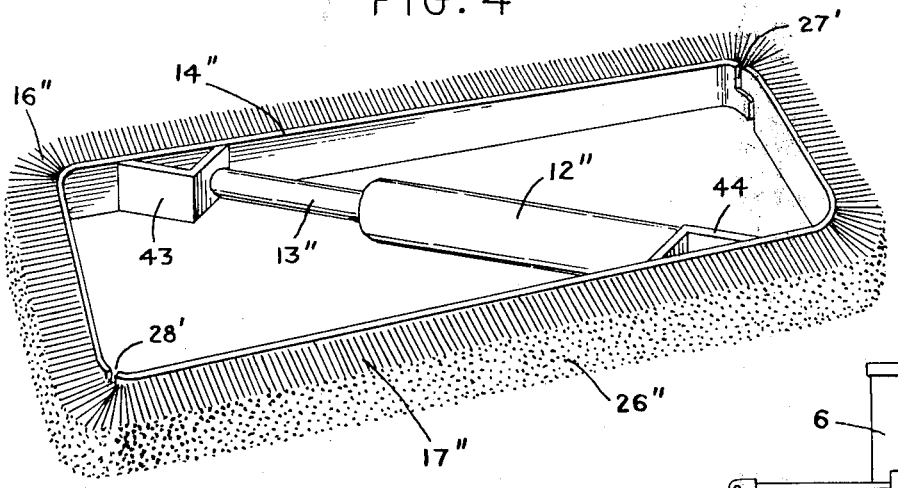
Figure 6:
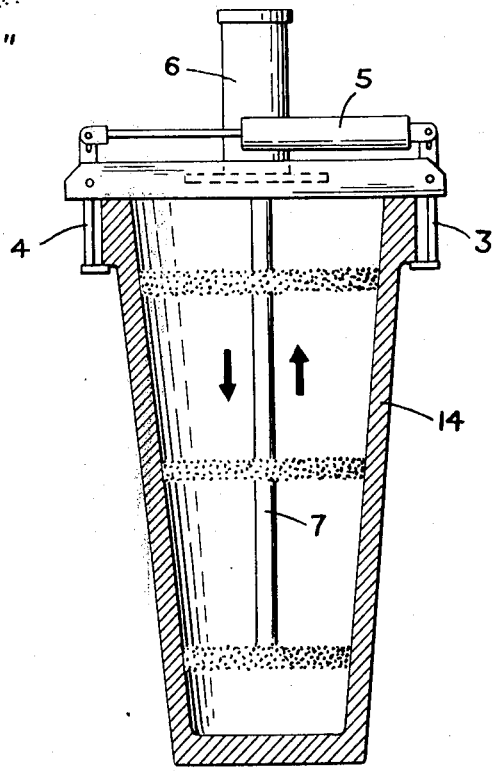
Figure 7:
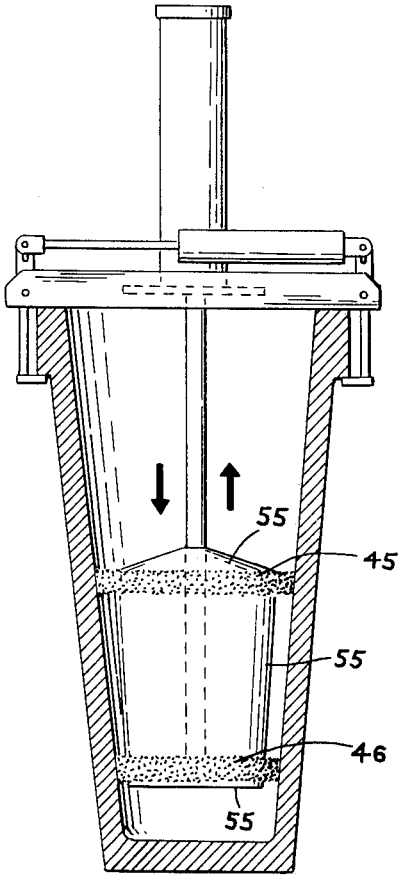
Figure 8:
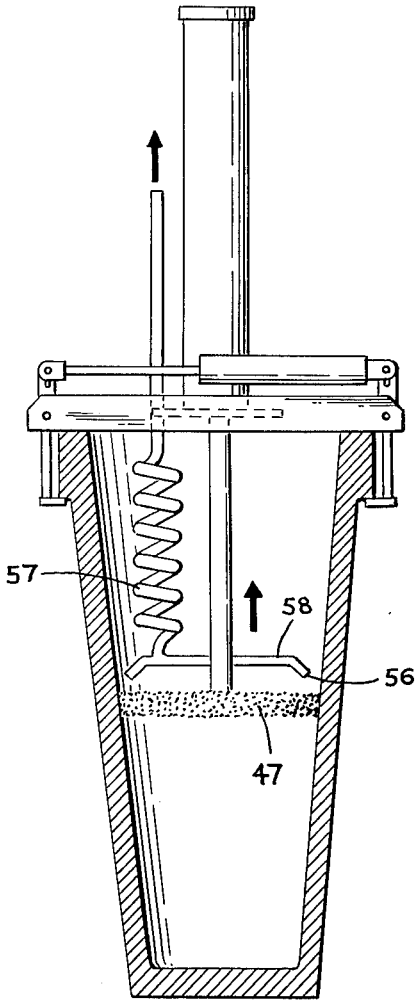
Figure 9:
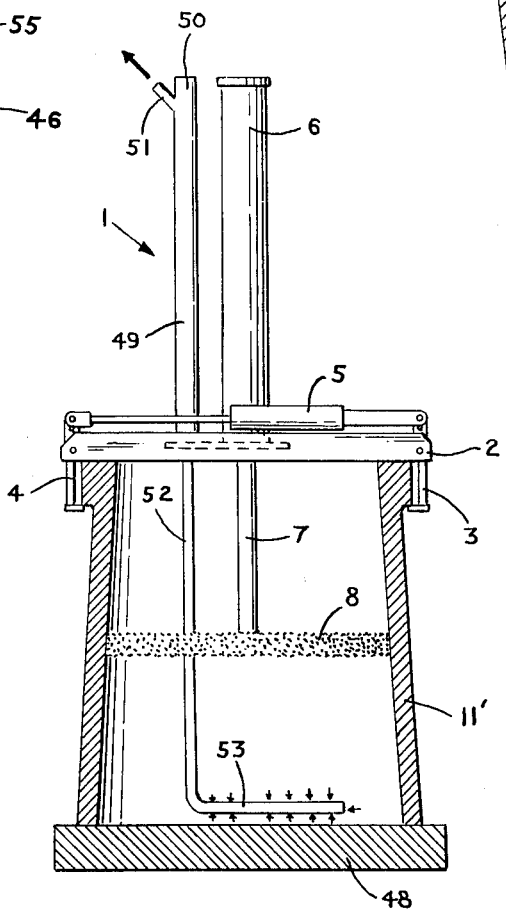

The present invention will be described in more detail with reference to the accompanying drawings, in which FIG. 1 shows a cleaning unit according to the present invention being inserted into a chill mould, FIGS. 2–5 show 4 different embodiments of transversal elements with brushes comprised in the cleaning unit according to FIG. 1, FIG. 6 shows a cleaning unit according to FIG. 1, secured to the chill mould, FIG. 7 shows a unit corresponding to the one according to FIG. 6, but with the exception that only two transversal elements are utilized, FIG. 8 shows a cleaning unit according to FIG. 6 but with only one transversal unit, and FIG. 9 shows a cleaning unit with a device for blowing a pressure medium for the exhaust of loose particles from the chill mould.

In FIG. 1, are shown a cleaning unit 1, which has a fastening plate 2 and two movable fastening devices 3 and 4, which can be actuated by a pressure medium cylinder 5, in which the pressure medium appropriately is air. At the fastening plate 2 a vertical pressure medium cylinder 6 including a corresponding piston (not shown) is arranged at right angles. A pressure indicator or manometer 54 of conventional design is preferably connected to the cylinder to indicate whether a predetermined maximal pressure in the cylinder is exceeded. The piston is mounted on a piston rod 7. The piston rod is movable axially. The cylinder and the piston 20*d* constitute a servo-system of conventional design. There are three transversal elements 8, 9 and 10 fastened to the piston rod. The elements are fastened in such a way that they are stationary in relation to the piston rod in axial direction, but not in the direction at right angles to the piston rod. At their peripheries the elements are provided with brushes with bristles directed outwards radially.

In the following, four different embodiments of transversal elements will be described.

Figure 2:
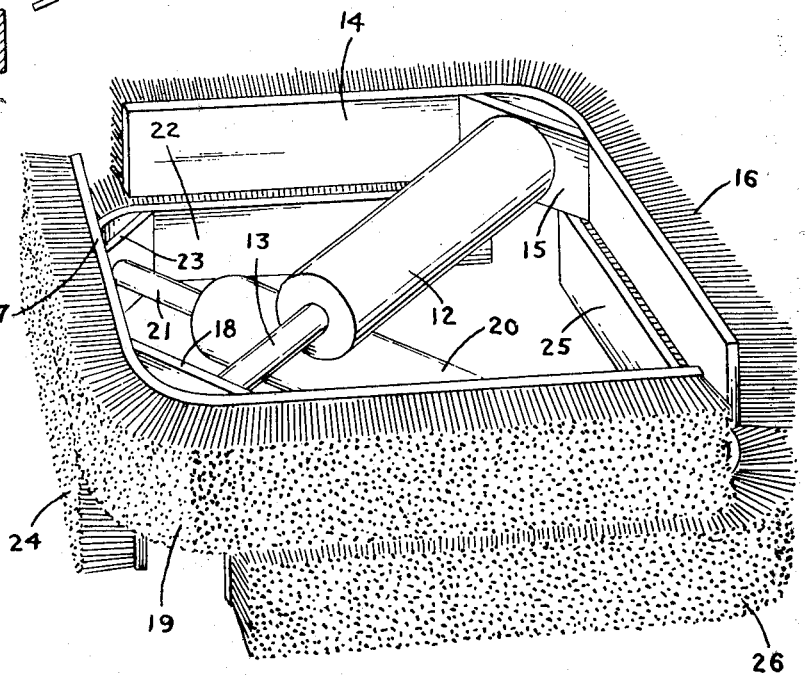

FIG. 2 shows a member which in reality consists of two elements, one on top of the other. The upper element comprises a pressure medium cylinder 12 with a piston connected to a piston rod 13. The pressure medium cylinder 12 is connected to a piston rod 13. The pressure medium cylinder is connected to a frame half 14, consisting of two parts bent substantially at right angles to each other. In the corner of the frame half there is a transversal flange 15, to which the pressure medium cylinder 12 is fastened. The frame half 14 has the character of a band, on the outside of which bristles 16 are arranged, the individual bristles being set more or less at right angles to the plane of the frame half. The piston rod 13 is fastened to a frame half 17, which is more or less identical to the frame half 14. In its corner, the frame half 17 has a transversal flange 18. The frame half 17 has bristles 19. The two frame halves 14 and 17 have two open corners, located opposite each other. The lower element is identical with the upper element, but is turned 90° in relation to the upper element. In this way the two elements together form a unit which is provided with bristles along its entire periphery. The lower element has a pressure medium cylinder 20, a piston rod 21, a frame half 22, a transversal flange 23 and bristles 24, as well as a frame half 25 and bristles 26.

Figure 3:
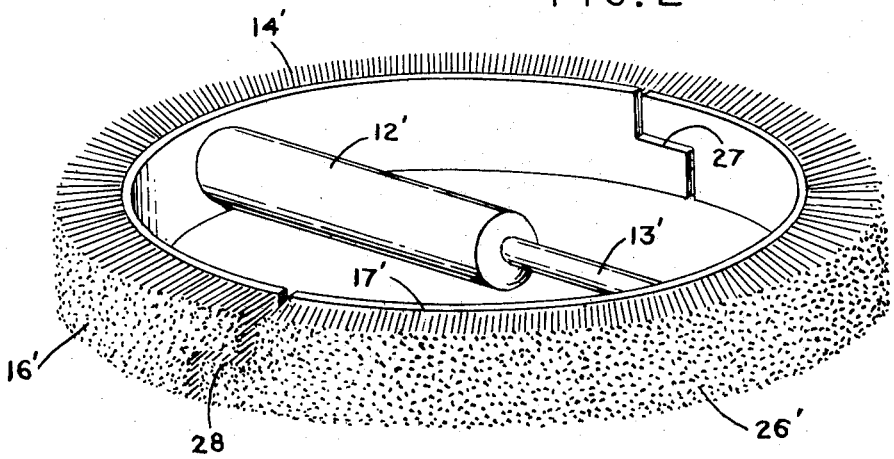

FIG. 3 shows an element which consists of only one part element, and not two part elements placed one on top of the other. In order to solve the problem of having bristles along the entire periphery of the element, the two frame halves of the element 2 have been made in such a way that two slits 27 and 28 with two halves overlapping each other have been obtained. The element according to FIG. 3 is intended for a chill mould with a circular cross-section, and is provided with a pressure medium cylinder 12′ with a piston rod 13′. The two frame halves are provided with bristles 16′ and 26′.

FIG. 4 shows an element of the same kind as the one according to FIG. 3, but intended for a chill mould with a rectangular cross-section. The element is provided with four part frames 31, 32, 33 and 34. In the corners of the part frames transversal flanges 15 and 18, and 29 and 30 are arranged. Two pressure medium cylinders 12 and 20 are provided, with the corresponding piston rods 13 and 21. These are fastened in the same way as shown in FIG. 2. The four part frames are made in such a way at their ends that slits with two overlapping halves are obtained, in the same way as shown in FIG.

3. These slits have been given the reference designations 39, 40, 41 and 42.

FIG. 5 shows an element corresponding to the one according to FIG. 3, but is intended for a chill mould with a rectangular cross-section and consists of only two frame halves. The figure thus shows a pressure medium cylinder 12'' with the corresponding piston rod 13'', which are fastened to two angular flanges 43 and 44, arranged at the frame halves 14'' and 17''. The ends of the frame halves are made in such a way that slits 27' and 28' are obtained, in the same way as shown in FIG. 3. The frame halves are moreover provided with bristles 16'' and 26'', directed outwards.

FIGS. 2 and 4 show two pressure medium cylinders, each actuating either one frame half or two quarter frame halves. However, it should be obvious that it should also be possible to utilize one single pressure medium cylinder which is then allowed to actuate e.g. four different link arms, which can also be jointed, each then actuating a frame half or a quarter of a frame.

Each of the transversal elements are fastened to the piston rod in any appropriate way whatsoever, provided that each element is stationary in relation to the axial direction of the piston rod. The connection of the different pressure medium cylinders to an appropriate source of pressure medium is obtained via the piston rod. The source of pressure medium is also connected to an indicating device 54 as shown in FIG. 1. This indicator senses the pressure in different situations, and if the pressure exceeds a predetermined value the pressure is shut off. The vertical pressure medium cylinder 6 is connected to a source of pressure, and controls the members in such a way that the piston rod 7 can be moved up and down in an axial direction.

The cleaning unit described above functions in the following way.

The cleaning unit is applied in a chill mould in the way shown in FIG. 1, in which it is shown inserted into the mould. When the cleaning unit has reached the position shown in FIG. 6, the fastening plate 2 rests on the top of the chill mould, and pressure is now fed to the cylinder 5. The pressure causes the fastening members 3 and 4 to engage cleats on the chill mould. The cleaning unit is then temporarily secured to the chill mould 11. Pressure is fed to the pressure medium cylinders of the transversal elements, which uses that the bristles will be pressed against the inner walls of the chill mould, and each element has bristles along its entire periphery against the corresponding periphery in the chill mould, and the frame parts of the elements are bent in such a way that they form a cross-section corresponding to the cross-section of the chill mould. In this situation, pressure is fed to the pressure medium cylinder, so that the three transversal brush elements will be moved up and down through the action of the piston rod 7. These movements can be repeated as many times as desired. In the present case three transversal members are used, which causes that the length of the axial movement will be ⅓ of the depth of the chill mould. If, at the reciprocating movement, there should be a cavity of such a kind that bristles become jammed, an increase in pressure will occur in the pressure medium cylinder of the element, which is sensed by the control member, which shuts of the pressure to said pressure medium cylinder, which involves that the bristles of the element will be moved away from the inner wall of the chill mould. In this situation the cleaning unit can easily be lifted off. At the normal cleaning procedure it is also necessary to reduce the pressure in order to be able to remove the cleaning unit. FIGS. 7 and 8 show a cleaning unit with two transversal elements 45 and 46 and with one transversal element 47. The fewer transversal elements are used, the longer the vertical pressure medium cylinder 6 will be applied.

As there will usually be pipes or hoses connected to the pressure medium cylinders, it is appropriate to arrange protective plates 55 which are movable transversally, in order to protect the pipes and hoses against over-heating when cleaning hot chill moulds. FIG. 7 shows the arrangement of these plates.

The cleaning unit 1 can be fastened to an arm on a vehicle which also is provided with a gripping device for chill moulds. By coaction with said gripping device and said arm the securing device with the fastening members 3 and 4 will become superfluous.

With the present invention the advantage is obtained that a brush element is directed under pressure against the walls of a chill mould, and then also its corners, which usually are very difficult to clean. Further, the advantage is that the pressure can also be removed, and the cleaning brush can then easily be removed from the chill mould.

The cleaning unit described functions generally entirely satisfactorily, but for more difficult working conditions it can be appropriate to provide the unit either with an accessory device for blowing in a pressure medium, for instance air, or with an exhaust device for removing scraped-off particles from the container. It should be obvious that the unit can also be provided with both of these accessory devices.

The two accessory devices can operate either individually or according to a predetermined sequence, of different types. Thus, the blown in medium can be used to whirl up scraped-off particles, whereupon the blowing is shut off and exhaust of the whirled up particles is started.

The blowing device can be fastened to the cleaning unit in any appropriate way whatsoever, and can be connected to a pressure medium unit for e.g. air. The blowing device is also provided with one or several nozzles 56, which can be directed and located in any way whatsoever. These nozzles may be located at the peripheral outline of the brushes and be secured to the brush parts 17' shown in FIG. 3. They are connected to a supply of a pressure medium by a flexible hose 57 and a tube 58. The exhaust device can be arranged in more or less exactly the same way as the blowing device, the exhaust device then being connected to some appropriate, known suction device that can achieve a sufficient suction effect for the moving particles.

The part of the blowing device and the exhaust device which is directly connected to the cleaning unit can be common for the two devices, the common device then being connected alternately to the suction device or the pressure medium unit.

The exhaust and blowing processes can each have varying values. Thus, both the suction and the blowing processes can be varied sinusoidally.

The accessory devices will be described in more detail with reference to FIG. 9, which more or less conforms to FIG. 1. Thus, the figure shows a cleaning unit 1 provided with a fastening plate 2 and with fastening members 3 and 4. The fastening members are controlled by means of a pressure medium cylinder 5. On the fastening plate 2 a vertical pressure medium cylinder is mounted, which has a piston connected to a piston rod 7. A transversal element 8 with peripheral brush is fastened to the piston rod 7. The cleaning unit is intended to be fastened to a chill mould 11', which coacts with a flat bottom plate 48. Fastened to the fastening plate there is a pipe 49 with two inlet branches 50 and 51, the branch 51 then being connected to a suction device not shown and the branch 50 being connected to a pressure medium unit. From the pipe 49 a pipe 52 extends, which is bent inside the chill mould. The bent part is provided with a number of openings 53.

The device described functions in the following way. When the cleaning unit has been fastened to the chill mould 11', as shown by the figure, the transversal element with the peripheral brush can be moved up and down in order to loosen particles from the walls of the chill mould. During this process an exhaust device is to be started, in which loosened particles are sucked up through the openings 53.

Under certain circumstances, however, it can be of advantage to start up a pressure medium unit, with which compressed air is blown into the chill mould, before the exhaust device is started. Loosened particles are then suspended in the chill mould. In this condition it is an advantage to shut off the pressure medium unit and switch on the exhaust device. This has the advantage that the particles are sucked up when they are in the suspended condition. It should be obvious that the shutting off of both the exhaust device and the pressure medium unit can take place in different sequences, all depending on what is the best way to remove loosened particles. In certain cases blowing with compressed air can contribute towards the releasing of the particles from the wall of the chill mould.

According to the figure shown, a common part at the cleaning unit, viz. the part with the reference designations 49–53, is used for both the exhaust device and the pressure medium unit. It should be obvious that both the exhaust device and the pressure medium unit can have their own piping systems instead of a common piping system. It should also be obvious that a separate piping system can be arranged inside of the chill mould, in any arbitrary way whatsoever, provided that the desired function is obtained. Thus, it is possible to arrange, inter alia, so that exhaust and blowing nozzles are arranged at the peripheries of the brushes.

I claim:

1. A cleaning device for brush cleaning the inside of the side wall of a receptacle having an opening in one of its end walls, said cleaning device comprising:

support means releasably attachable to said end wall in a position overlying said opening;

at least one brushing member composed of a pair of complementary parts shaped and disposed to define an outer peripheral outline approximately matching the inner cross-sectional outline of the receptacle side wall to be cleaned, brushing means secured to the outside of each of said parts, said parts being movable relative to each other so that the outer peripheral outline of the brushing means is selectively placeable in a position in which the brushing means are in brushing contact with the inner side wall surface and a position in which they are out of contact therewith; and actuating means including a rod extending into said support means concentrically with a lengthwise axis of the receptacle, said brushing means being crosswise and centrally disposed relative to the rod and secured thereto against rotational and axial displacement, first moving means mounted on said support means coacting with said rod for axially displacing the same in either direction and thus also the brushing means, and second moving means mounted on said brushing member coupled to the two parts thereof for selectively moving the brushing means into and out of brushing contact with the side wall to be cleaned.

2. The cleaning device according to claim 1 wherein each of said parts has about half the length of the peripheral outline of the brushing member and engaging each other with a slidable overlap, said parts being disposed in substantially co-planar relationship.

3. The cleaning device according to claim 1 wherein said brushing member comprises a second pair of parts, the parts of the two pairs being disposed in superimposed relationship, each one of the parts having a peripheral length short of half the total peripheral length of the brushing member, thereby defining gaps between the ends of the parts of each pair, the parts being angularly staggered so that one part of each pair overlie the gap between the parts of the other pair, thereby providing continuous brushing means about the peripheral outline of the brushing member.

4. The cleaning device according to claim 1 wherein said brushing means comprises a multitude of bristles extending outwardly from the brushing member.

5. The cleaning device according to claim 1 wherein said first moving means comprise a fluid-operated servo-system including a cylinder and a piston rod and a rod mounting the brushing member, said rod constituting the piston rod of the servo-system to effect axial reciprocating movements of the rod and thus of the brushing member.

6. The cleaning device according to claim 5 and comprising a pressure indicating means connected to said servo-system for indicating the pressure therein.

7. The cleaning device according to claim 1 wherein said second moving means comprises a fluid-operated servo-system including a cylinder and a piston rod, said cylinder being coupled to one part of the brushing member and piston rod being coupled to the other part of the brushing member for selectively moving said parts into and out of the position in which the brushing means on the parts of the brushing member are in brushing engagement with the receptacle side wall to be brushed.

8. The cleaning device according to claim 1 and comprising blowing means for blowing out particles loosened by the action of said brushing member, said blowing means being mounted on the support means and including a pipe terminating with its blowing openings within a receptacle to be brushed.

9. The cleaning device according to claim 8 wherein said blowing openings are located at the brushing member.

10. The cleaning device according to claim 1 and comprising a suction means for sucking out particles loosened by said brushing member, said suction means being mounted on said support means and including a suction pipe extending through the support means so as to terminate with its suction opening within a receptacle to be brushed.

11. The cleaning device according to claim 1 and comprising blowing means for blowing out particles loosened by said brushing member and suction means for sucking out loosened particles, said blowing means and suction means including a common pipe extending through said support means into a receptacle to be brushed, said pipe having two inlet branches for alternately generating blowing pressure or suction within and through the common pipe.

12. The cleaning device according to claim 1 and comprising movable heat shielding means secured to said actuating means and located adjacent to the sides of the brushing member.

* * * * *